US008774432B2

(12) United States Patent
Fröhlich et al.

(10) Patent No.: US 8,774,432 B2
(45) Date of Patent: Jul. 8, 2014

(54) METHOD FOR ADAPTING A HEARING DEVICE USING A PERCEPTIVE MODEL

(75) Inventors: Matthias Fröhlich, Jiangsu (CN); Matthias Latzel, Eggolsheim (DE); Henning Puder, Erlangen (DE); Andre Steinbuss, Erlangen (DE)

(73) Assignee: Siemens Medical Instruments Pte. Ltd., Singapore (SG)

( * ) Notice: Subject to any disclaimer, the term of this patent is extended or adjusted under 35 U.S.C. 154(b) by 925 days.

(21) Appl. No.: 12/669,594

(22) PCT Filed: Jul. 9, 2008

(86) PCT No.: PCT/EP2008/058910

§ 371 (c)(1),
(2), (4) Date: Jan. 19, 2010

(87) PCT Pub. No.: WO2009/016010

PCT Pub. Date: Feb. 5, 2009

(65) Prior Publication Data

US 2010/0202636 A1 Aug. 12, 2010

(30) Foreign Application Priority Data

Jul. 27, 2007 (DE) ..... 10 2007 035 171

(51) Int. Cl.
*H04R 25/00* (2006.01)

(52) U.S. Cl.
USPC ..... 381/314; 381/60; 381/312

(58) Field of Classification Search
USPC ..... 381/58, 60, 312, 314, 320, 321, 57, 381/104; 600/559; 73/585
See application file for complete search history.

(56) References Cited

U.S. PATENT DOCUMENTS 4,953,112 A * 8/1990 Widin et al. ..... 703/6
4,972,487 A 11/1990 Mangold et al.

(Continued)

FOREIGN PATENT DOCUMENTS

DE 69603166 T2 2/2000
DE 10318191 A1 7/2004

(Continued)

OTHER PUBLICATIONS

Moore, B.C.J., "Use of a loudness model for hearing aid fitting. IV. Fitting hearing aids with multi-channel compression so as to restore 'normal' loudness for speech at different levels", British Journal of Audiology, 2000, pp. 165-177.

(Continued)

*Primary Examiner* — Huyen D Le
(74) *Attorney, Agent, or Firm* — Laurence A. Greenberg; Werner H. Stemer; Ralph E. Locher

(57) ABSTRACT

Adaptation of hearing devices is rendered more convenient and more accurate with a method for adapting a hearing device to a hearing device support. The hearing device is selected on the basis of initial data of several hearing devices with respect to the data relating to hearing loss of the hearing device support. The selected hearing device is preset using a target reinforcement curve and, optionally, a setting of the preset hearing device is finely adjusted. At least one of the mentioned steps of selecting and presetting as well as, optionally, the step of fine adjustment is carried out by means of a single perceptive model which individualizes the hearing loss data projected by the hearing loss of the hearing device support.

5 Claims, 2 Drawing Sheets

(56) References Cited

U.S. PATENT DOCUMENTS

| | | | | |
|---|---|---|---|---|
| 5,727,119 | A | 3/1998 | Davidson et al. | |
| 5,729,658 | A | 3/1998 | Hou et al. | |
| 5,835,611 | A * | 11/1998 | Kaiser et al. | 381/321 |
| 6,167,138 | A | 12/2000 | Shennib | |
| 7,010,133 | B2 | 3/2006 | Chalupper et al. | |
| 8,081,768 | B2 * | 12/2011 | Steinbuss | 381/60 |
| 2002/0051549 | A1 * | 5/2002 | Uvacek et al. | 381/312 |
| 2004/0218771 | A1 | 11/2004 | Chalupper et al. | |
| 2006/0245610 | A1 | 11/2006 | Chalupper | |
| 2007/0135862 | A1 | 6/2007 | Nicolai et al. | |
| 2010/0250264 | A1 | 9/2010 | Philippe et al. | |

FOREIGN PATENT DOCUMENTS

| | | | |
|---|---|---|---|
| DE | 103 08 483 | A1 | 9/2004 |
| DE | 60105576 | T2 | 11/2005 |
| DE | 10 2005 020 317 | A1 | 11/2006 |
| EP | 0 661 905 | A2 | 7/1995 |

OTHER PUBLICATIONS

International Search Report, dated Nov. 24, 2008.

Bächler et al.: "Hörgeräte können bereits hören, wann beginnen sie zu denken?" 10. Multidisziplinäres Kolloquium der Geers Stiftung, Phonak AG, 2002, DE, Sep. 27, 2002—English summary.

* cited by examiner

METHOD FOR ADAPTING A HEARING DEVICE USING A PERCEPTIVE MODEL

BACKGROUND OF THE INVENTION

Field of the Invention

The present invention relates to a method for adjusting a hearing device to suit a hearing device wearer through selection of a hearing device with the aid of a comparison of the technical data of several hearing devices with data relating to the hearing loss of the hearing device wearer, presetting of the selected hearing device with a target amplification curve, and fine adjustment of a setting of the preset hearing device.

Hearing devices are wearable hearing apparatuses which are used to assist the hard-of-hearing. In order to accommodate numerous individual requirements, various types of hearing devices are available such as behind-the-ear (BTE) hearing devices, hearing device with external receiver (RIC: receiver in the canal) and in-the-ear (ITE) hearing devices, for example also concha hearing devices or completely-in-the-canal (ITE, CIC) hearing devices. The hearing devices listed as examples are worn on the outer ear or in the auditory canal. Bone conduction hearing aids, implantable or vibrotactile hearing aids are also available on the market. The damaged hearing is thus stimulated either mechanically or electrically.

The key components of hearing devices are principally an input converter, an amplifier and an output converter. The input converter is normally a receiving transducer e.g. a microphone and/or an electromagnetic receiver, e.g. an induction coil. The output converter is most frequently realized as an electroacoustic converter e.g. a miniature loudspeaker, or as an electromechanical converter e.g. a bone conduction hearing aid. The amplifier is usually integrated into a signal processing unit. This basic configuration is illustrated in FIG. 1 using the example of a behind-the-ear hearing device. One or a plurality of microphones 2 for recording ambient sound are built into a hearing device housing 1 to be worn behind the ear. A signal processing unit 3 which is also integrated into the hearing device housing 1 processes and amplifies the microphone signals. The output signal for the signal processing unit 3 is transmitted to a loudspeaker or receiver 4, which outputs an acoustic signal. Sound is transmitted through a sound tube, which is affixed in the auditory canal by means of an otoplastic, to the device wearer's eardrum. Power for the hearing device and in particular for the signal processing unit 3 is supplied by means of a battery 5 which is also integrated in the hearing device housing 1.

The selection, presetting and fine adjustment of the hearing device by the acoustician using an adjustment software contribute to achieving the goal of meeting the individual needs of the hard-of-hearing person in terms of speech comprehension and sound quality. This requires extensive experience on the part of the acoustician, which is however increasingly difficult to achieve in view of the increasing complexity of hearing systems and short product cycles, and so the risk of inadequate assistance increases.

The adjustment software frequently gives support that is intended to help the inexperienced acoustician perform suitable adjustment steps. Thus for example during hearing device selection the audiological "matching level" of a hearing device is displayed for the hearing loss presented, or a rough preselection of suitable adjustment strategies is performed by the software. However this preselection is based frequently on technical features of the hearing devices and is not focused specifically on the potential psychoacoustic benefit of the hearing device.

The publication US 2002/0111745 A1 discloses a portable hearing analysis system. Here, parameters of a hearing response can be obtained by means of an audiometer. A response forecast is used to implement an initial setting for a hearing device.

Furthermore, the publication EP 0 661 905 A2 describes a method for adjusting a hearing device, and a corresponding hearing device. Using a perceptive model, a psychoacoustic variable, in particular loudness, is obtained on the one hand for a standard group of people and on the other hand for a single individual. Correction data, by means of which the signal transmission at the hearing aid is designed or adjusted ex situ or controlled in situ, is determined on the basis of the difference between the two psychoacoustic variables.

BRIEF SUMMARY OF THE INVENTION

The object of the present invention is to simplify and improve the adjustment of a hearing device to suit a hearing device wearer so that better assistance can be ensured.

This object is achieved in accordance with the invention by means of a method for adjusting a hearing device to suit a hearing device wearer through selection of a hearing device with the aid of original data for several hearing devices in respect of data relating to the hearing loss of the hearing device wearer and one or both of the following steps: Presetting of the selected hearing device with a target amplification curve, and fine adjustment of a setting of the preset hearing device, with at least one of the steps of selecting, presetting and fine adjustment being carried out by means of a single perceptive model which is individualized by means of hearing loss data that maps the hearing loss of the hearing device wearer.

Thus in the adjustment of the hearing device, sensitivity variables are advantageously also taken into consideration without high computing overhead. In this way the hearing device can therefore be selected and preset in advance according to the perception of the individual. The individual psychoacoustic variables can also be taken into consideration in the fine adjustment so that the quality of adjustment increases.

The perceptive model preferably returns loudness, sharpness of sound, harshness, pleasantness, listening effort and/or speech intelligibility as a psychoacoustic variable, so that selecting, presetting and/or fine adjustment is carried out using this (these) psychoacoustic variable(s). However other psychoacoustic variables can also be returned by the perceptive model and used for the adjustment.

For the selection of the hearing device it is advantageous if a predefined sound is fed to a simulation model of each of the hearing devices available for selection, the resulting simulation data is entered in the perceptive model and the selection of the hearing device is carried out with the aid of the psychoacoustic data obtained from the perceptive model. As early as the initial phase it is thus possible to reduce the hard-of-hearing person's burden of selecting the hearing device.

For the presetting of a selected hearing device it is furthermore advantageous if a predefined sound is fed to a simulation model of the hearing device with several target amplification curves, the resulting simulation data is conducted to the perceptive model, and a target amplification curve is determined with the aid of psychoacoustic data from the perceptive model. Thus a relatively good adjustment can be carried out as early as the first individual setting (first fit) of the hearing device, so that the hearing device wearer receives a more positive overall impression of the new hearing device as early as the first wearing.

For fine adjustment an adaptive signal processing algorithm of the hearing device can also be adjusted with the aid of psychoacoustic data from the perceptive model. Since the fine adjustment is typically carried out in several iterations, the hearing device wearer can be spared several visits to the acoustician as a result of the perceptive model.

In addition, it is particularly advantageous if the fine adjustment is carried out on the basis of data that the hearing device wearer has captured by means of data logging or recording of individual acoustic situations. Thus a highly individual adjustment to suit the personal sound environment can be achieved.

According to a further embodiment, through the perceptive model several psychoacoustic variables can be obtained, the psychoacoustic variables can be weighted individually, and the weighted psychoacoustic variables can be used for selecting, presetting and/or fine adjustment. Thus a multidimensional parameterization can be carried out very effectively with the aid of sensitivity variables.

BRIEF DESCRIPTION OF THE SEVERAL VIEWS OF THE DRAWING

The present invention is described in more detail with reference to the appended drawings, in which.

DESCRIPTION OF THE INVENTION

The exemplary embodiment shown in more detail below represents a preferred embodiment of the present invention.

The inventive use of a perceptive model, which takes into consideration the individual audiogram or corresponding other data that maps hearing loss, provides at the various steps of the adjustment of the hearing device a clear improvement in the quality of the measures proposed by the adjustment software. Upon a specific stimulus the model returns predictions of critical psychoacoustic characteristics such as e.g. loudness, sharpness of sound, harshness, pleasantness, listening effort, subjective speech intelligibility, etc.

The adjustment of the hearing device can be broadly divided into three steps: hearing device selection, hearing device presetting, and optionally hearing device fine adjustment. The first two steps are indicated in FIG. 2 and the third step is indicated in FIG. 3.

Figure 1:
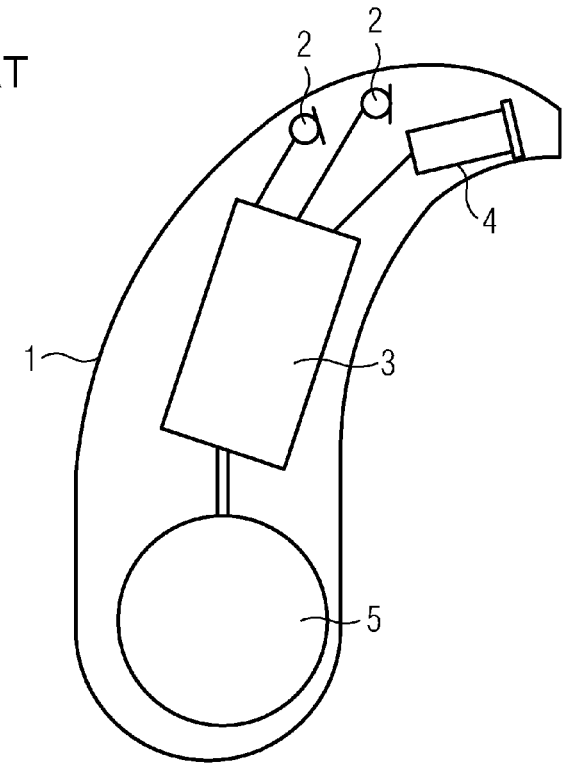
FIG. 1 PRIOR ART
FIG. 1 shows the basic design of a hearing device according to the prior art.
Figure 2:
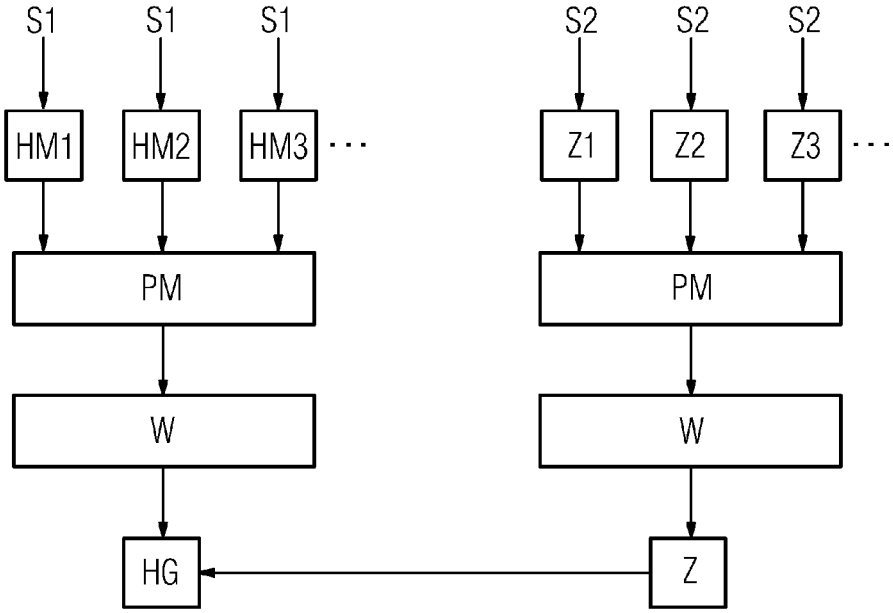
FIG. 2 shows a flowchart for the selection and presetting of a hearing device.
Figure 3:
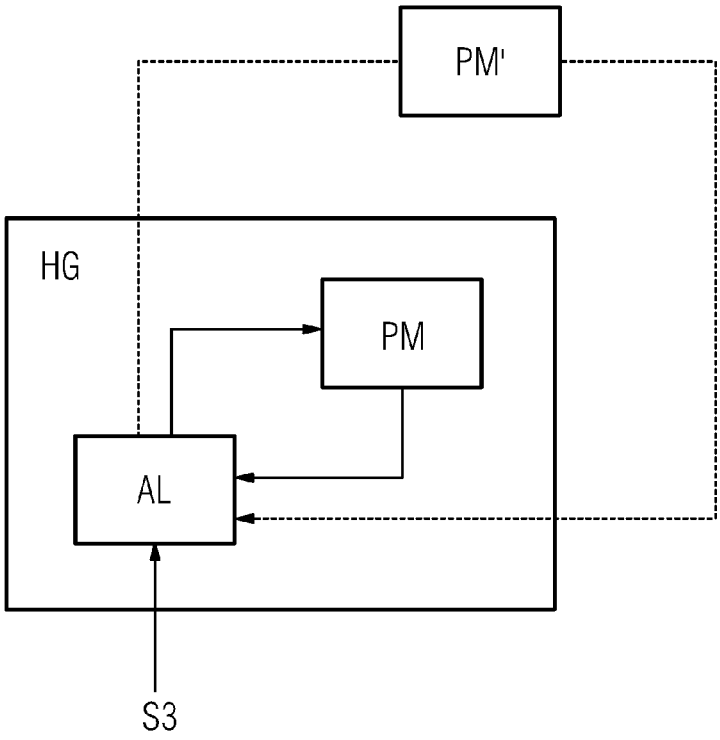
FIG. 3 shows a block diagram for the fine adjustment of a hearing device.

According to FIG. 2, in the step of hearing device selection the perceptive model PM is used, in which one or several typical sounds S1, which are selected by the hard-of-hearing person together with the acoustician, are processed with simulation models HM1, HM2, HM3, etc. of the various hearing devices available for selection and then fed to the perceptive model PM. In this way one or more devices are preselected according to the algorithmic features or frequency response of the various hearing devices.

According to another embodiment the data for the preselection can already be made available to the software in the form of a database, so that no computing-intensive online calculation of the hearing device model and of the subsequent perceptive model has to be performed at the acoustician's office.

In the second step for the adjustment of the hearing device, namely hearing device presetting, the model is changed in order to select the optimal target amplification curve, as also indicated in FIG. 2. Firstly, suitable sounds S2 are processed with the hearing device model, i.e. with the various target amplification curves Z1, Z2, Z3, etc. and the output signals are fed to the perceptive model PM. On the basis of the results the acoustician can then make a selection W and thus choose a suitable target amplification Z or generate one from the target amplification curves. I.e. a strategy is selected that is suited to the individual, depending whether the hard-of-hearing person e.g. places a greater value on a balanced sound, or whether he/she is primarily interested in an improvement in speech intelligibility.

In an alternative embodiment the results for various sounds for representative hearing losses could in turn already be stored as a database, so that no computing-intensive online calculation has to be performed in order to be able to make the selection W. In this case the individual hearing loss would be allocated to the closest representative hearing loss. This means that the perceptive model is parameterized on the basis of the representative hearing loss or several representative hearing losses. In each case the selected target amplification curve Z is then used for the selected hearing device HG.

In the optional step of the adjustment of the hearing device, the perceptive model PM according to FIG. 3 can be used to perform suitable fine adjustment steps, in particular in the case of adaptive algorithms AL, which are difficult to optimize in the laboratory situation. In specific terms, a sound S3 is thus processed by means of the adaptive algorithm and fed to the perceptive model PM. The algorithm AL is parameterized with the aid of a psychoacoustic value returned by the perceptive model. As indicated in FIG. 3 the perceptive model can be implemented in the hearing device HG itself or can run as a perceptive model PM' outside the hearing device on a computer. Thus the acoustician can modify parameters on the basis of statements made by the hard-of-hearing person (which perceptive dimension is to be optimized, or which problem is to be solved) and, with the aid of the model simulation, can immediately check whether the desired result has been achieved.

Information from a wear test, which was captured e.g. by means of data logging, can additionally be incorporated as support for further adjustment or fine adjustment. The description of the acoustic situation, e.g. an audio file or alternatively technical variables such as level, SNR ratios, classification, etc. (here also understood to be a result of "data logging") can be fed to the perceptive model and the model of the device for fine adjustment. The software can then independently optimize the parameters of the hearing device such that a maximum is attained in one dimension, e.g. loudness. Provided there is no absolute maximum, the result could also be found in several settings, which the hard-of-hearing person subsequently assesses him/herself for suitability. In this case too it is conceivable to carry out the elaborate calculation in the adjustment software in advance by means of representative sounds and to populate the adjustment software itself with a database of problem situations and suitable solution proposals.

As described above, in accordance with the invention psychoacoustic i.e. perceptive variables can be made available by the adjustment software at the various steps of adjustment of the hearing device. In each of these steps the perceptive model allows for an individual weighting of each of the different psychoacoustic dimensions, i.e. whether the individual's priority is subjective speech comprehension, for example, or instead sound quality.

The invention claimed is:

1. A method for adjusting a hearing device to suit a hearing device wearer, the method which comprises:

providing a single perceptive model individualized by way of hearing loss data mapping a hearing loss of the hearing device wearer;

selecting a hearing device with the aid of original data for several hearing devices in respect of data relating to the hearing loss of the hearing device wearer; and presetting the selected hearing device with a target amplification curve; and effecting a fine adjustment of a setting of the preset hearing device based on data from a wear test that the hearing device wearer has captured by way of data logging of individual acoustic situations in a personal sound environment of the hearing device wearer; and thereby carrying out at least one of the steps of selecting, presetting, and effecting the fine adjustment by way of the single perceptive model;

the perceptive model returning a variable selected from the group consisting of loudness, sharpness of sound, harshness, pleasantness, and listening effort as a psychoacoustic variable, and one or more of the steps of selecting, presetting, and effecting the fine adjustment being carried out using the psychoacoustic variable.

2. The method according to claim 1, wherein the step of selecting the hearing device comprises feeding a predefined sound to a simulation model of each of the hearing devices available for selection, the resulting simulation data is entered in the perceptive model and the selection of the hearing device is carried out with the aid of the psychoacoustic data obtained from the perceptive model.

3. The method according to claim 1, wherein the step of presetting the selected hearing device comprises feeding a predefined sound to a simulation model of the hearing device with several target amplification curves, conducting the resulting simulation data to the perceptive model, and determining a target amplification curve with the aid of psychoacoustic data from the perceptive model.

4. The method according to claim 1, wherein the fine adjustment comprises adjusting an adaptive signal processing algorithm of the hearing device with the aid of psychoacoustic data from the perceptive model.

5. The method according to claim 1, which comprises obtaining several psychoacoustic variables through the perceptive model, weighting the psychoacoustic variables individually, and using the weighted psychoacoustic variables for one or more of selecting, presetting, and/or fine adjustment.

* * * * *